US005671691A

United States Patent [19]

Birger

[11] Patent Number: 5,671,691

[45] Date of Patent: Sep. 30, 1997

[54] RUDDER DEVICE

[75] Inventor: Kullmann Birger, Oslo, Norway

[73] Assignee: Kvaerner A.S., Oslo, Norway

[21] Appl. No.: 689,559

[22] Filed: Aug. 12, 1996

Related U.S. Application Data

[63] Continuation of Ser. No. 347,431, Mar. 31, 1995, abandoned.

[30] Foreign Application Priority Data

May 26, 1992 [NO] Norway ..... 922096

[51] Int. Cl.[6] ..... B63H 25/06

[52] U.S. Cl. ..... 114/162; 440/54

[58] Field of Search ..... 114/280, 281, 114/282, 128, 138, 141, 162, 39.1; 440/54; 244/87, 88, 91

[56] References Cited

U.S. PATENT DOCUMENTS

| | | | |
|---|---|---|---|
| 421,008 | 2/1890 | Martin | 114/128 |
| 3,269,347 | 8/1966 | Koenig . | |
| 3,354,857 | 11/1967 | Hobday | 114/282 |
| 3,371,636 | 3/1968 | Sharp | 114/39.1 |
| 4,016,824 | 4/1977 | Thyvold | 114/165 |

FOREIGN PATENT DOCUMENTS

| | | |
|---|---|---|
| 125041 | 7/1972 | Norway . |
| 142163 | 3/1980 | Norway . |
| 144769 | 7/1981 | Norway . |

*Primary Examiner*—Sherman Basinger
*Attorney, Agent, or Firm*—Merchant, Gould, Smith, Edell, Welter & Schmidt, P.A.

[57] ABSTRACT

A rudder device for water-going craft or aircraft, where there is provided in the vessel a cavity (21) which is open to the outside of the vessel. In the cavity there is provided a body (2) which can rotate about an axis (3), which extends in the cavity (21) and out through the opening (22). The body (2) supports a rudder blade (7) which is fixed or movable in relation to the body (2) substantially in the direction of the axis of rotation (3) through the opening (22) and arranged to be secured by the body (2) after having been moved. The vessel is steered by turning the body (2) by the vessel's steering device.

4 Claims, 4 Drawing Sheets

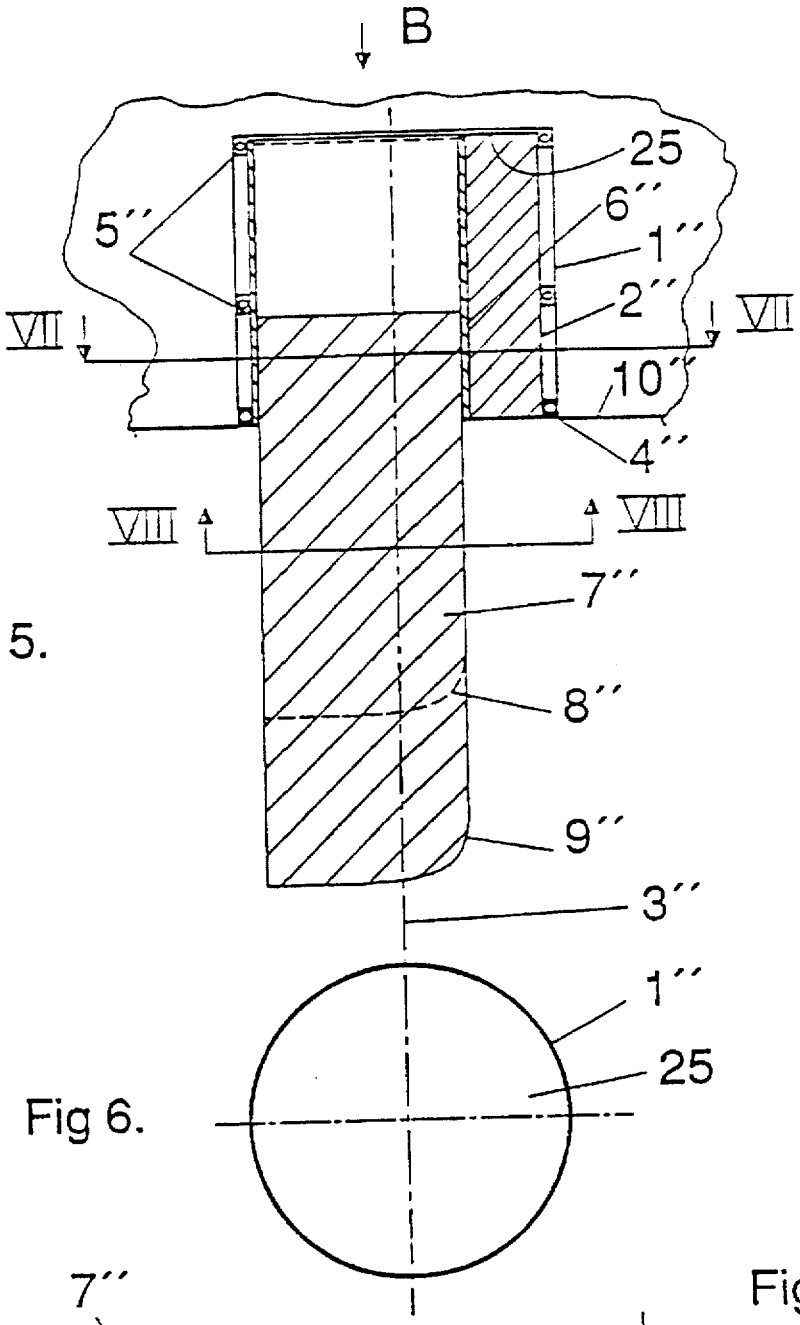
Fig 5.
Fig 6.
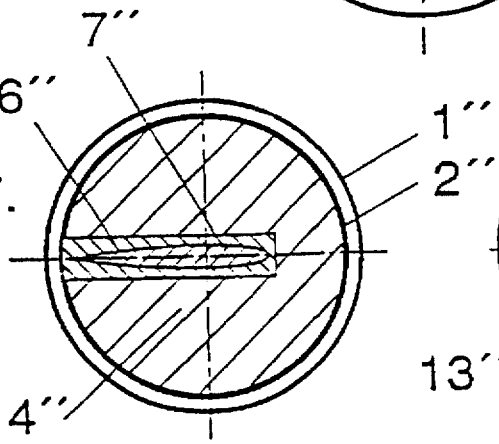
Fig 7.
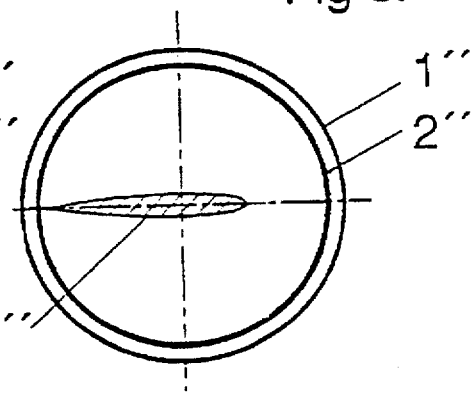
Fig 8.

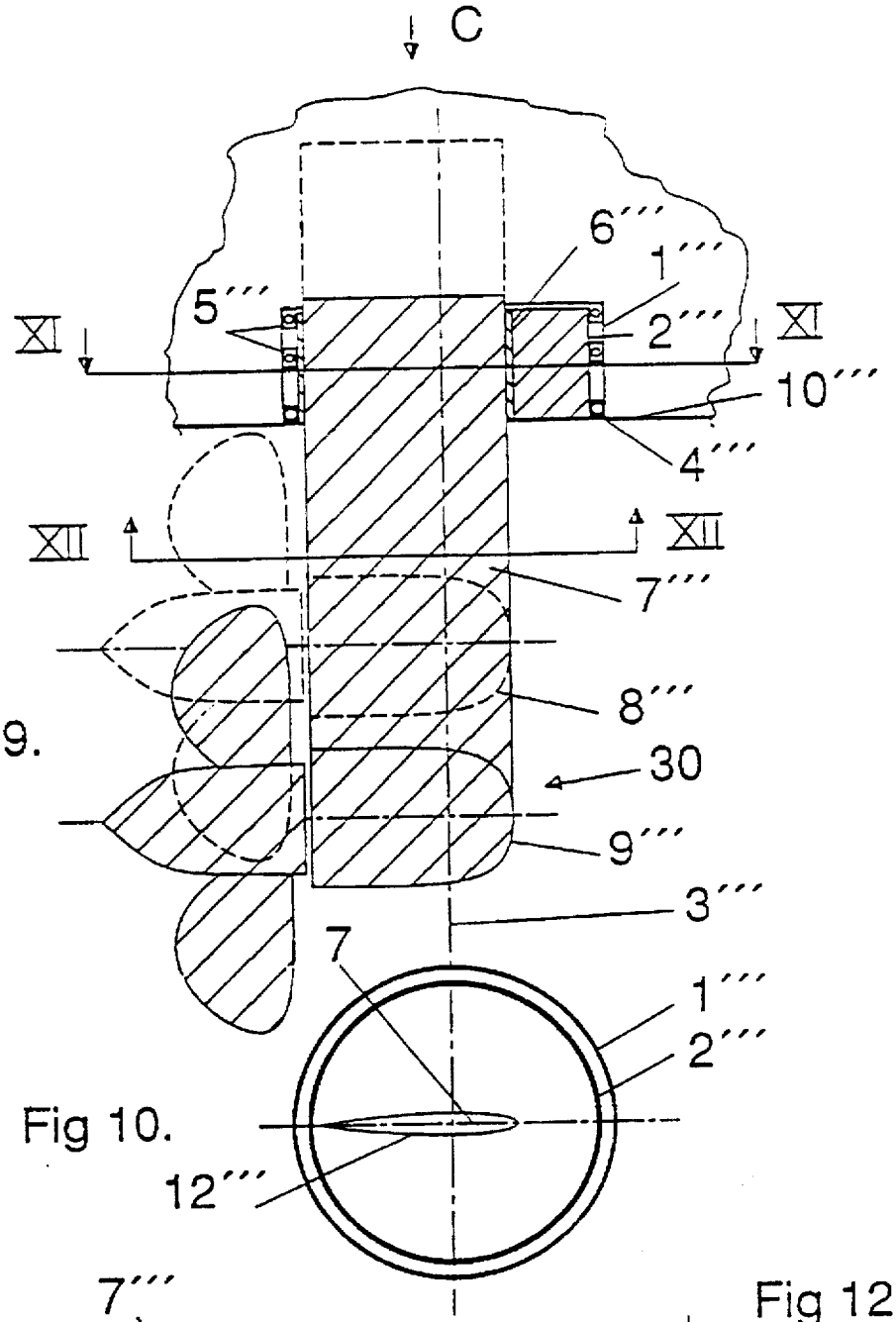
Fig 9.
Fig 10.
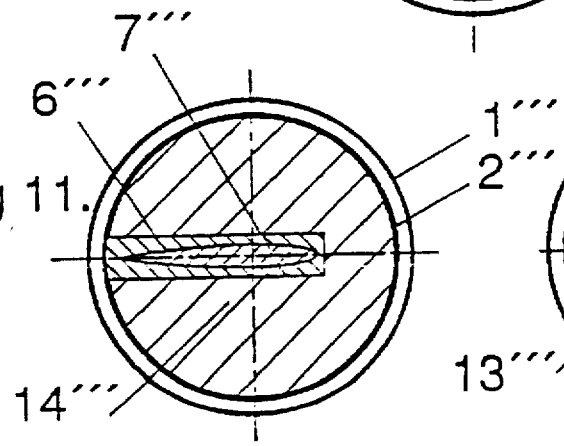
Fig 11.
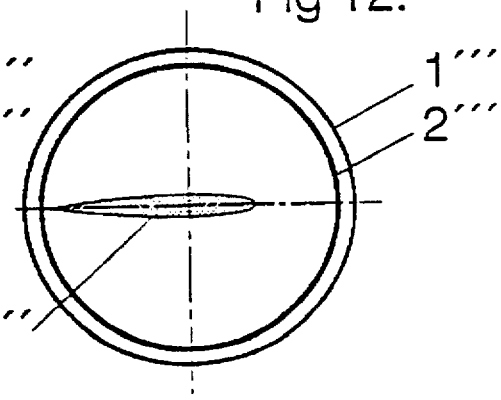
Fig 12.

RUDDER DEVICE

BACKGROUND OF THE INVENTION

This is a Continuation application of application Ser. No. 08/347,431, filed Mar. 31, 1995 and now abandoned.

The invention relates to a rudder device of the type which is described in the introduction to claim 1.

From U.S. Pat. No. 4,016,824 there is known a rudder device of this type, where the cavity is provided in a conical shape and tapered towards the opening and arranged to receive a corresponding conical body. A slanting sleeve passes through the body and is attached thereto. A rudder and which projects away from the vessel's hull when the body is mounted in the cavity, is attached to an end portion of a rotatable rudder stock which runs through the sleeve.

This device has an arrangement for turning the body about its longitudinal axis in relation to the vessel's hull and a securing device for attaching the body in different angular positions and for canting the rudder blade in relation to the vessel's hull. The turning device, however, is not intended for steering the vessel. And a rudder blade is not arranged to be moved inwards in the hull with this device in order to reduce the vessel's draught.

Since the rudder blade is mounted via a rudder stock, this is of vital importance with regard to the strength of the device, and since it may be necessary for the rudder stock to have a large diameter, this will also be the case for the rudder blade, and this may be undesirable.

It is well nigh impossible to replace a rudder blade when the vessel is in the water or underway, either because the old one is damaged or when a rudder blade has to be installed with a different plane shape and/or profile.

The body can be turned in such a way that the rudder blade is tilted somewhat upward and backward. Even though this arrangement can thereby provide a slightly shallower draught when the rudder blade is canted than when it projects vertically downward, this is not the object of the device.

SUMMARY OF THE INVENTION

The object of the invention is to provide a rudder device of the type described in the introduction which is not encumbered with the above-mentioned disadvantages.

The characteristics of the rudder device according to the invention are characterized by the features in the claims presented.

BRIEF DESCRIPTION OF THE INVENTION

The invention will now be described in more detail with reference to the drawing which illustrates schematically embodiments of the invention.

FIG. 5 is a longitudinal section similar to FIG. 1, but through a second embodiment of a rudder device according to the invention.

FIG. 6 is a view of the rudder device illustrated in FIG. 5, viewed in the direction of arrow B.

FIG. 7 is a section along line VII—VII through the rudder device which is illustrated in FIG. 5.

FIG. 8 is a section along line VIII—VIII through the rudder device which is illustrated in FIG. 5.

FIG. 9 is a longitudinal section similar to FIG. 1, but through a third embodiment of a rudder device according to the invention.

FIG. 10 is a view of the rudder device illustrated in FIG. 9, viewed in the direction of arrow C.

FIG. 11 is a section along line XI—XI through the rudder device which is illustrated in FIG. 9.

FIG. 12 is a section along line XII—XII through the rudder device which is illustrated in FIG. 9.

DETAILED DESCRIPTION OF THE PREFERRED EMBODIMENT

Figure 1:
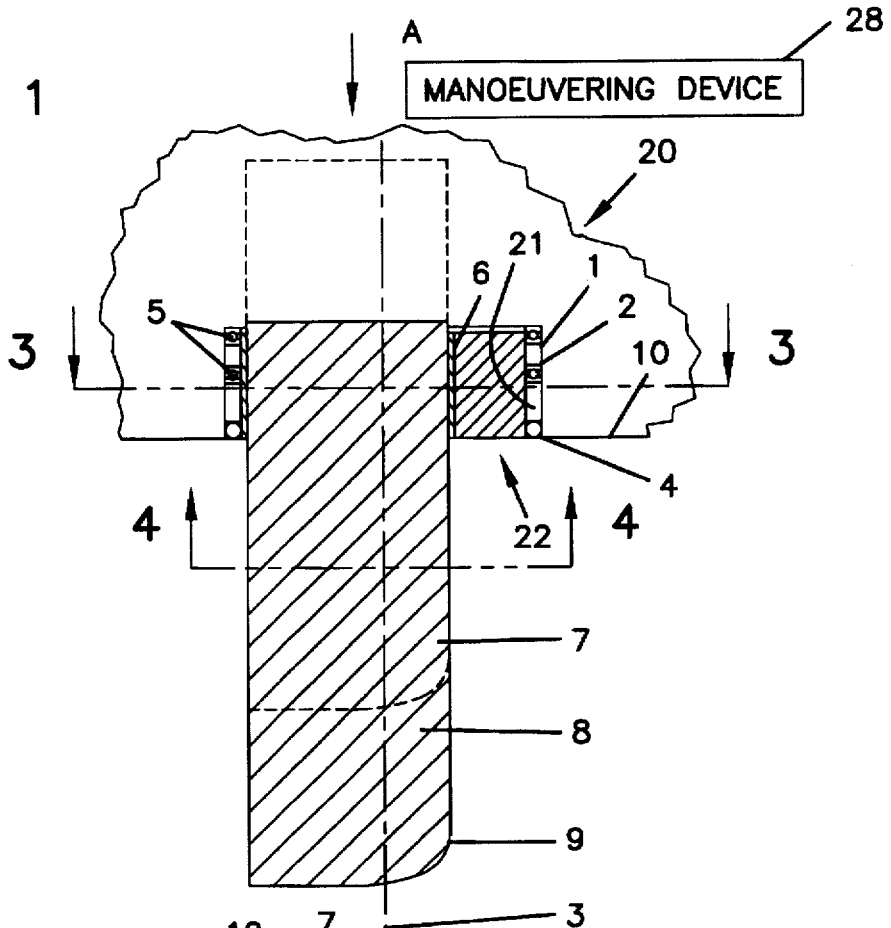
FIG. 1 is a longitudinal section through a portion of a vessel with a first embodiment of the rudder device according to the invention.

As illustrated in FIG. 1, there is provided in a hull 20 of a vessel, e.g. a boat, an aeroplane or the like, which is arranged to be moved in a fluid and steered by means of the dynamic fluid forces which are exerted against it, a circular cylindrical cavity 21 which leads into an opening 22 in the vessel's skin 10, and wherein there is attached in a suitable manner, e.g. by gluing, screws, welding or the like, a tubular cylinder 1 to the adjacent hull sections in the cavity. The cavity's and the cylinder's longitudinal axis 3 extends preferably perpendicular to that section of the skin which is located near the opening.

In the cylinder 1 there is mounted via a lower and two upper annular bearings 4 and 5 a circular cylindrical body 2 which extends coaxially in relation to the cylinder 1 in such a manner that the body can rotate about its longitudinal axis in relation to the cylinder.

Figure 2:
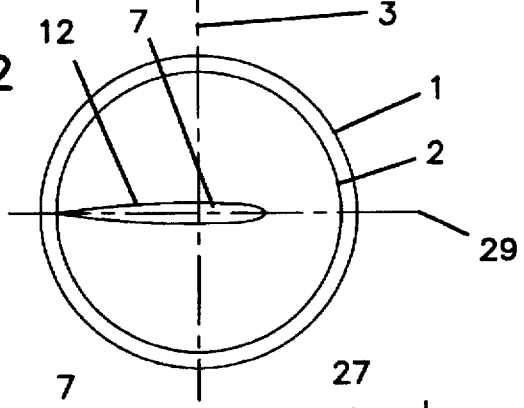
FIG. 2 is a view of the rudder device illustrated in FIG. 1, viewed in the direction of arrow A.
Figure 3:
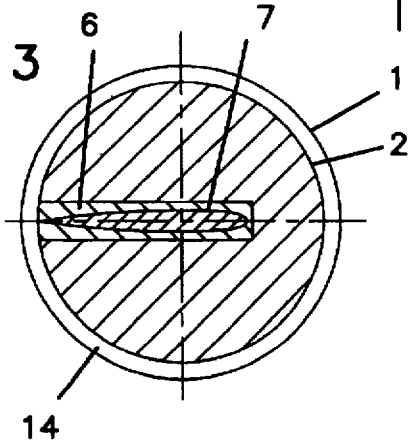
FIG. 3 is a section along line III—III through the rudder device which is illustrated in FIG. 1.
Figure 4:
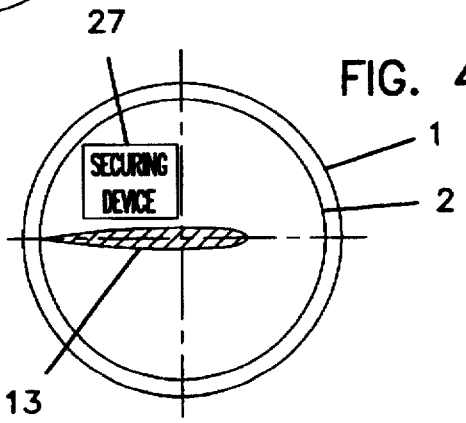
FIG. 4 is a section along line IV—IV through the rudder device which is illustrated in FIG. 1.
Figure 13:
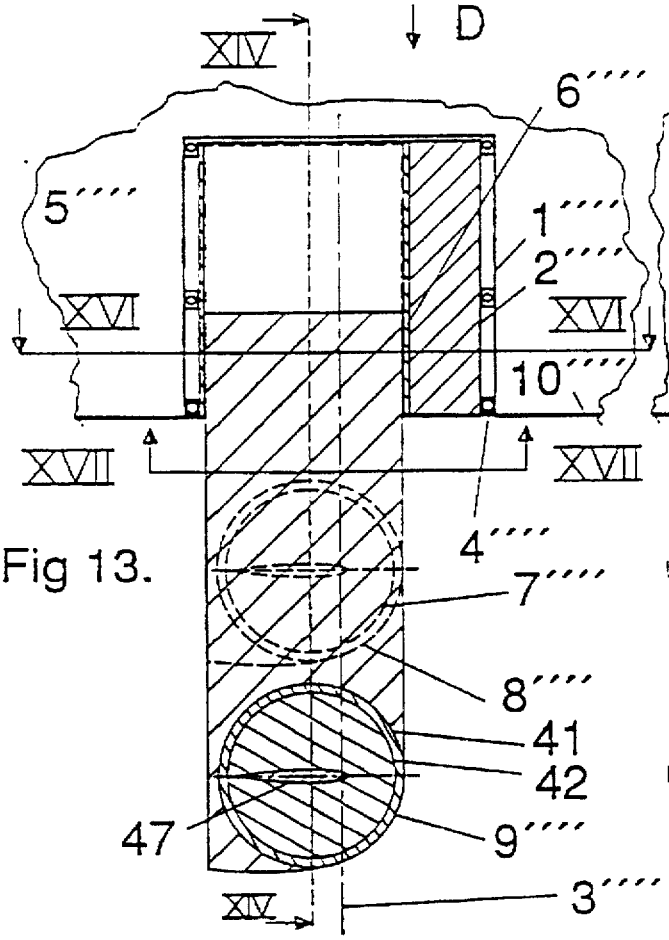
FIG. 13 is a longitudinal section through a fourth embodiment of a rudder device according to the invention.
Figure 14:
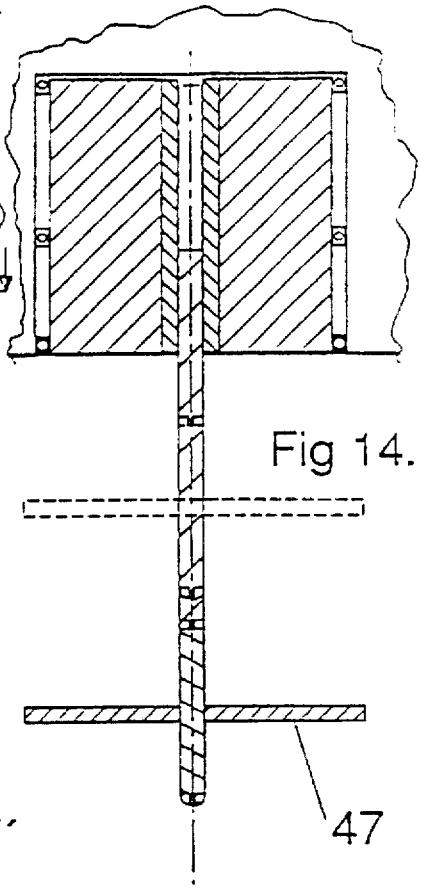
FIG. 14 is a section along line XIV—XIV through the rudder device which is illustrated in FIG. 13.
Figure 15:
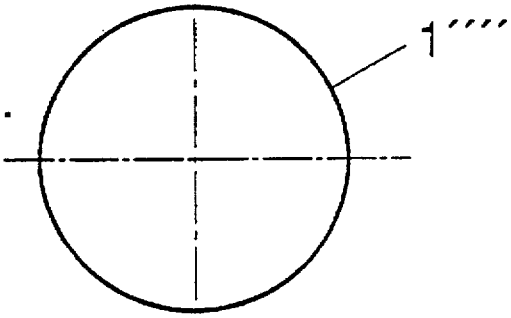
FIG. 15 is a view of the rudder device illustrated in FIG. 13, viewed in the direction of arrow D.
Figure 16:
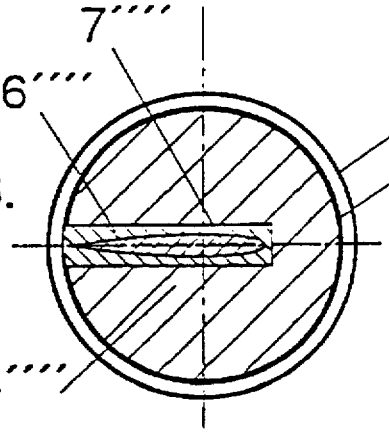
FIG. 16 is a section along line XVI—XVI through the rudder device illustrated in FIG. 13.
Figure 17:
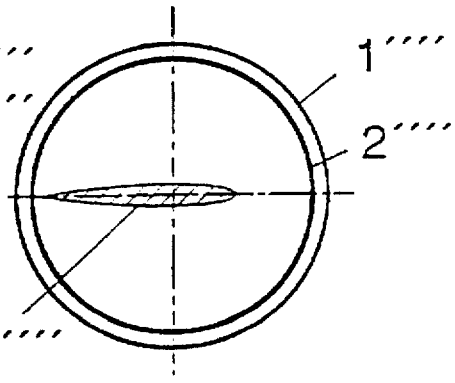
FIG. 17 is a section along line XVII—XVII through the rudder device illustrated in FIG. 13.

In the body there is provided an axially extending, through-going groove or slot 12 whose cross section shape corresponds to the cross section contour of a first rudder blade 7 having a rudder blade plane 29 as shown in FIG. 2., whose surface over substantially the greatest part of the body's length is in the form of a cylinder surface, and whose cross section is in the form of a symmetrical wing profile, the body being pushed into the groove 12. The body can comprise an outer, tubular casing which is filled with a foamed plastic 14, wherein there is cast a block 6 of a material with good sliding properties, e.g. plastic, and the slot 12 can be provided in this block 6.

A hoisting device (not shown) can be attached to the upper section of the rudder blade 7, thus enabling this to be raised and lowered steplessly in relation to the body 2 between a first, upper position 8 (indicated by dotted lines) and a second, lower position 9 where the rudder blade's upper end is substantially aligned with the upper end of the body 2. The device can, however, be designed in such a way that the lower end of the rudder blade in the rudder blade's upper position is aligned with the surrounding section of the hull skin 10. Thus these positions correspond to positions which determine the vessel's least and greatest draught.

In order to ensure that the rudder blade is securely attached after it has been brought into a desired position in relation to the body 2, a securing device 27 can be provided for this purpose. In a simple embodiment, e.g. in small sailing boats, such a secure attachment can be achieved by having a tight fit between the rudder blade and the block 6, thus causing a frictional force to be exerted between these components which, although it has to be overcome by the hoisting device for movement of the rudder blade, is strong enough to prevent those fluid forces which are exerted against it when the vessel is underway from moving it in relation to the body. Further securing of the rudder blade can be carried out with tackle or a locking pin. In a simple embodiment of this kind and since the cylinder 1 in this embodiment is open upward, the hoisting device can be in the form of a handle which is attached to the upper end section of the rudder blade, and whereby this can be moved by hand in the same way as a centreboard.

The body 2 is rotatable by means of a vessel's rudder manoeuvering device 28.

The body 2 can via a suitable device (not shown), e.g. a disc groove, formed around the upper portion of the body, wherein there extends a rope which is similarly connected to a wheel, or via a tiller which is attached to the upper section of the body or the like, be arranged to be turned in relation to the cylinder, thus enabling the rudder to be turned in this way for steering of the vessel.

In the following description of embodiments 2–4 of the rudder device the same reference numbers as for embodiment no. 1, will be used for corresponding parts but with the addition of a number of apostrophes corresponding to the number of the embodiment.

In FIGS. 5–8 there is illustrated a second embodiment of a rudder device according to the invention which comprises a cylinder 1", the upper part of which is sealingly closed by means of a cover 25. This cover can form a section of a deck.

In the third embodiment of the rudder device which is illustrated in FIGS. 9–12 a propeller unit is connected with the rudder blade 12'".

In the fourth embodiment of the rudder device which is illustrated in FIGS. 13–17, there is connected with the end section of the rudder blade 7"" which in its pushed out state is located far from the hull, a second rudder blade 47 extending athwart the rudder blade 7"". This second rudder blade 47 can be provided slidingly in its longitudinal direction in a circular disc 42 which in turn can be mounted along its circumference in a short casing 41, which is attached to the first rudder blade 7"", a mounting of this kind permitting the second rudder blade 47 to be turned about its longitudinal axis in the casing by means of a (not shown) turning device. Such a device can, e.g. be suitable for speedboats, hydrofoils or aeroplanes, where it then becomes possible to vary the degree of both the sideways steering and the supporting lifting force.

With the invention a better mounting of the rudder blade is obtained, since no traditional rudder stock is provided which ordinarily constitutes a severely stressed component of a rudder device. The large diameter of the mounting device for the body 2 results in smaller forces and moments being exerted than those which have to be withstood by the bearings in the traditional design. Difficulties are avoided in connection with binding when the bearings become "locked" as a result of bending of the rudder stock.

The absence of a rudder stock allows a narrower rudder profile to be used than in known designs. Furthermore the rudder blade can be manufactured, e.g. cast, in one piece, a process which entails lower production costs.

With the device according to the invention a stepless adjustment of a vessel's draught is achieved, and the removal of the rudder blade possibly together with a propeller, a transmission or the like, a fin or a wing is simplified, which makes for inexpensive maintenance and repair.

Moreover the rudder device is simple and includes few sensitive components, thus providing a robust and reliable construction which is also cheaper than other designs and which provides a variable draught.

With the rudder device according to the invention a draught can be obtained corresponding to the draught for the hull skin. This is particularly important for sailing boats which must have a deep-draught rudder in order to achieve full steering effect when sailing, but where it is desirable to reduce the draught in order to improve access to shallow waters and marinas where boats may be pulled right on to the beach or on to a ramp. This is also relevant for utility vessels of many kinds in, e.g. countries where there are no ordinary harbours, but only shallow bays or sandy beaches.

The rudder device is also applicable for sailing boats where it is of interest to optimize the rudder surface with regard to lift and resistance depending on wind and sea state. The invention allows the rudder to be turned repeatedly an angular distance of 360 degrees. This feature is of interest in connection with thrusters, e.g. in ferries which should be able to sail in both ways in the vessel's longitudinal direction.

It has been stated above that there are provided, e.g. a lower bearing and two upper bearings for the body 7, but this number can, of course, be altered.

It should be understood that the height adjustment of the rudder blade by means of the hoisting device can be carried out while sailing.

Even though it is stated in the above that the rudder blade can be movable in relation to the body 7, it is obvious, however, that it can instead be permanently attached to it.

I claim:

1. A rudder device and a craft having a craft's skin, comprising:

a cavity having an opening through the craft's skin;

a body being mounted in the cavity in such a manner that the body rotates about an axis which extends from an inner section of the cavity and through the opening and is rotated by a manoeuvering device;

a rudder blade extending substantially in a rudder blade plane the rudder blade having an upper end and a lower end;

a through-going slot in the body having an upper opening end and a lower opening end, the through-going slot being adapted to receive the rudder blade in such a way that the rudder blade is moveable between a first position whereby the upper end of the rudder blade extends out of the upper opening end of the through-going slot and a second position whereby the upper end of the rudder blade is substantially aligned with the upper opening end of the through-going slot; and wherein the rudder blade is translationally movable in the slot.

2. A rudder device and craft according to claim 1, wherein further comprising a securing mechanism which is adapted to secure the rudder blade after a movement thereof relative to the body.

3. A rudder device and craft according to claim 2, wherein the slot has an aft end and a leading end corresponding to an aft edge and a leading edge of the rudder, respectively, the axis of rotation of the body extending inside the slot, and the aft end being located further away from the axis than the leading end.

4. A rudder device and craft according to claim 1, wherein the slot has an aft end and a leading end corresponding to an aft edge and a leading edge, respectively, of the rudder, the axis of rotation of the body extending inside the slot, and the aft end being located further away from the axis than the leading end.

* * * * *